US009073068B2

(12) United States Patent
Krayer et al.

(10) Patent No.: US 9,073,068 B2
(45) Date of Patent: Jul. 7, 2015

(54) SLOTTED NOZZLE

(75) Inventors: Elmar Krayer, Langenargen (DE); Alfred Göhring, Salem (DE); Thomas Jeltsch, Friedrichshafen (DE); Jens Ulbrich, Friedrichshafen (DE)

(73) Assignee: J. Wagner GmbH, Markdorf (DE)

( * ) Notice: Subject to any disclaimer, the term of this patent is extended or adjusted under 35 U.S.C. 154(b) by 681 days.

(21) Appl. No.: 13/359,907

(22) Filed: Jan. 27, 2012

(65) Prior Publication Data

US 2012/0160935 A1 Jun. 28, 2012

Related U.S. Application Data

(63) Continuation of application No. PCT/DE2010/000899, filed on Jul. 30, 2010.

(30) Foreign Application Priority Data

Aug. 5, 2009 (DE) ..... 10 2009 036 147
Nov. 17, 2009 (DE) ..... 10 2009 053 449

(51) Int. Cl.
*B05B 7/02* (2006.01)
*B05B 7/06* (2006.01)
*B05B 7/08* (2006.01)

(52) U.S. Cl.
CPC ..... *B05B 7/025* (2013.01); *B05B 7/066* (2013.01); *B05B 7/0815* (2013.01); *B05B 7/0823* (2013.01); *B05B 7/083* (2013.01)

(58) Field of Classification Search
CPC ..... B05B 7/0815; B05B 7/0823; B05B 7/083
USPC ..... 239/290, 291, 300, 301, 525, 526, 532, 239/398, 418, 420, 423, 424, 433
See application file for complete search history.

(56) References Cited

U.S. PATENT DOCUMENTS

| | | | | | |
|---|---|---|---|---|---|
| 2,139,133 | A | * | 12/1938 | Paasche | 239/298 |
| 4,884,742 | A | * | 12/1989 | Bekius et al. | 239/71 |
| 4,948,053 | A | * | 8/1990 | Hufgard | 239/301 |
| 5,060,869 | A | * | 10/1991 | Bekius | 239/599 |
| 5,102,051 | A | * | 4/1992 | Smith et al. | 239/297 |
| 5,217,168 | A | | 6/1993 | Svendsen | |
| 5,435,491 | A | | 7/1995 | Sakuma | |
| 7,407,572 | B2 | | 8/2008 | Steffens et al. | |
| 8,590,810 | B2 | * | 11/2013 | Woodgate et al. | 239/297 |

FOREIGN PATENT DOCUMENTS

| | | | | |
|---|---|---|---|---|
| CN | 101001937 | A | | 7/2007 |
| EP | 0 596 939 | B1 | | 12/1998 |
| EP | 1 118 387 | A2 | | 7/2001 |
| GB | 520 367 | A | | 4/1940 |
| GB | 520367 | A | * | 4/1940 |
| GB | 520367 | A | | 4/1940 |

OTHER PUBLICATIONS

Chinese Search Report, Chinese Application No. 201080045648.0, dated Jun. 24, 2014 (2 pages).

* cited by examiner

*Primary Examiner* — Justin Jonaitis
(74) *Attorney, Agent, or Firm* — Burr & Brown, PLLC

(57) ABSTRACT

The invention relates to a spray head having a slot-shaped central air outlet opening and preferably a slot-shaped paint nozzle for forming a flat jet of paint in an air-propelled application process.

20 Claims, 10 Drawing Sheets

SLOTTED NOZZLE

CROSS REFERENCE TO RELATED APPLICATIONS

This application is a continuation of International Application No. PCT/DE2010/000899 filed Jul. 30, 2010, which designated the United States, and claims the benefit under 35 USC §119(a)-(d) of German Application No. 10 2009 036 147.2 filed Aug. 5, 2009 and German Application No. 10 2009 053 449.0 filed Nov. 17, 2009, the entireties of which are incorporated herein by reference.

FIELD OF THE INVENTION

The present invention relates to a spray head for generating a flat jet of paint at a paint spray gun or a paint spray lance or a spray head.

BACKGROUND OF THE INVENTION

According to the present invention, the spray head can also be used for other air-propelled application processes that make use of the function according to the present invention of generating a flat jet at the spray head.

There are a number of fundamental technical principles in the field of application processes using spraying, for example, when spraying paint or spraying varnish. As well as the so-called airless processes that atomize paints at high pressure and apply them to a surface, there are many processes using compressed air. In these, a paint jet emerging from a nozzle is atomized by means of quantities of air (sheathing air) that flow past and is thus transported as atomized sprayed paint toward a working plane. The working plane that is arranged at an appropriate working distance for applying a coating is in this way struck by the paint jet and the paint is thus applied to it. Appliances that operate with compressed air, as well as so-called HVLP (high-volume low-pressure) appliances are, inter alia, known from the prior art and differ in some operating parameters, for example, the pressure of the air at the nozzle.

This genre of appliance from the prior art is suitable for providing a flat jet of paint, which has advantages when paint is applied to a surface. In comparison with a radially symmetrical round paint jet, a flat jet provides greater homogeneity in the application of paint, similar to applying it with a paintbrush or a roller, giving a much higher quality of paint coverage.

Paint spraying devices are known from the prior art, for example from EP 0 596 939 B1, in which a radially symmetrical round paint jet, emerging from a paint nozzle, is deformed by air deflection means which are arranged at the sides of the paint nozzle and take the form of air horns, so that a generated flat jet of paint is created in the region of a working plane.

However, the flat jet profiles which are generated using the prior art often create an inadequate shaping of the jet profile, in particular when highly viscous paint materials such as, for example, wall paint, or viscous varnishes are used. An improved flat jet profile is always desirable as the quality of the work and quality of the resulting paint coverage is greatly dependent on the jet profile of the paint jet provided by a paint spray gun.

SUMMARY OF THE INVENTION

The object of the present invention is therefore to further develop a spray head for generating a flat jet of paint at a paint spray gun or at a paint spray lance, which spray head overcomes the disadvantages of the prior art.

The present invention relates to a spray head for generating a flat jet of paint at a paint spray gun or at a paint spray lance, which spray head comprises an air gate, a paint nozzle with a needle valve and an air cap arranged downstream from the air gate in the direction of air flow. The spray head for a paint spray lance is preferably designed without a needle valve if, for example, a viscous construction material such as, for example, mortar is to be sprayed. The air gate hereby has a centrally arranged through opening for the passage of the paint nozzle. Also situated in the air cap is a centrally arranged through opening for the passage of the paint jet or the paint nozzle, and of a flow of sheathing air surrounding the paint jet or the paint nozzle. Depending on whether the paint spray gun or paint spray lance has a nozzle for internal or external mixing, the paint nozzle, or the jet of paint or construction material which has already been ejected from the nozzle, passes through the central opening in the air cap.

Furthermore, the spray head according to the present invention comprises at least one air through opening which is radially spaced apart in the air gate from the central through opening, and at least one air deflection means which is preferably designed as an air horn and which is arranged on an air through opening, associated therewith, in the air cap. The air horn deflects an air jet passing through toward the paint jet or the paint/air jet, and communicates with a source of air in or on the body of the gun via the air through opening in the air cap and an air through opening in the air gate, which openings have a similar radial spacing from the center of the air cap or the air gate.

According to the present invention, the spray head is characterized in that the central through opening in the air cap is designed as a slot-shaped air cap opening with a first longitudinal axis of this air cap opening and first transverse axis of this air cap opening which is shorter than the longitudinal axis.

The spray head according to the present invention with a slot-shaped air cap opening generates by virtue of its shape a flat jet that is widened during its travel between the spray head and a working plane.

In a further development of the spray head, the spray head is characterized in that the air deflection means is arranged on a narrow side of the central air cap opening along the longitudinal axis of this slot-shaped opening, and a paint jet emerging from the spray head is widened along the transverse axis of the slot-shaped air cap opening.

By virtue of its slot-shaped air cap opening, the spray head according to the present invention generates a widened flat jet that is widened in the direction of the transverse axis of the slot-shaped air cap opening, so that a horizontally extending slot in the air cap results in a vertically extending flat jet.

In a further development of the spray head according to the present invention, the paint nozzle is also designed as a slot-shaped paint nozzle.

In this way, the formation of the flat jet is amplified.

In a preferred embodiment of the arrangement according to the present invention, it is provided that two air deflection means, preferably two air horns, are provided symmetrically with respect to the center of the air cap.

The two air deflection means, which are arranged at the respective narrow ends of the slot-shaped opening in the air cap, have an amplifying effect, caused by the flow of air passing through them, from both sides on the formation of the flat jet, so that a thereby improved flat jet is provided for coating a surface.

In another preferred development of the subject of the present invention, pressure-relief openings are provided which allow an additional outlet of air from the paint spray gun body without the emerging air affecting the paint jet generated, in particular the flat jet.

By virtue of such pressure-relief openings, it can be ensured that a sufficient air flow volume can always be delivered, for example, to provide sufficient cooling for an air-supply blower. This is particularly necessary when the flow of air delivered is used, for example, as a flow of cooling air, as is the case with many of the radial blowers used in HVLP devices.

In a development of the spray head according to the present invention, means are additionally provided which supply air alternatively to either the pressure-relief openings or the air deflection means. In this way, a maximum available flow of air can be used, although the air deflection means may possibly be switched off for particular applications. A corresponding principle for use with a round-jet paint nozzle is disclosed in the prior art in EP 0 596 939 B1.

The advantageous embodiments of the means for alternatively switching between the pressure-relief openings or the air deflection means will be described in detail in this description with reference to the exemplary embodiments. Reference is explicitly made here to the details of the exemplary embodiments.

The present invention also relates to a spray head for generating a flat jet of paint at a paint spray gun or at a paint spray lance, which spray head comprises an air guide, in particular an air gate. It is also conceivable that a paint spray gun or paint spray lance is provided with a spray head according to the present invention without an air gate, for example when the paint nozzle is suspended correspondingly centrally in the air guide of the paint gun body and there are no air deflection means in the region of the air cap. An air guide is necessary only when different air through openings are correspondingly made to coincide with different air outlet openings, in order in this way to provide other necessary functions in addition to simply generating a flat jet.

The further spray head according to the present invention for a paint spray gun furthermore comprises a paint nozzle with a needle valve, and an air cap which is arranged downstream from the air guide in the direction of the air flow and has a centrally arranged through opening for the passage of a paint jet or a paint nozzle and of sheathing air surrounding the paint jet or the paint nozzle. The spray head of a paint spray lance for spraying viscous construction material preferably does not have a needle valve. The spray head is characterized in that the central through opening in the air cap is designed as a slot-shaped opening, the slot-shaped opening having a first longitudinal axis of the air cap opening and a first transverse axis of the air cap opening which is shorter than the longitudinal axis.

In this way, a spray head is provided which can be manufactured simply and cost-effectively, generates a flat jet, and requires no additional air deflection means. It may also be possible to dispense with an air gate, in particular when the gun body is used as an air guide.

This further spray head according to the present invention can be used in many applications which can include a wide variety of coating materials.

In a development of the further spray head according to the invention with no air deflection means, it is provided that the paint nozzle is likewise designed as a slot-shaped nozzle. A preferred embodiment of the spray head according to the invention generates a flat paint jet which strikes a working plane that is placed at a working distance from the spray head and is arranged perpendicularly to the spraying direction, wherein the longitudinal axis of the flat jet, and a transverse axis of the flat jet which is shorter than the longitudinal axis of the flat jet, are rotated by 90° about the spraying direction with respect to a longitudinal axis of the slot-shaped air cap opening and the transverse axis of the slot-shaped air cap opening.

In this way, a flat jet is likewise generated which, for example, when the slot-shaped opening of the air cap is arranged horizontally, generates a vertically directed flat jet on a working plane.

The principles according to the present invention of a spray head for generating a flat paint jet at a paint spray gun will be explained further below. The term passage is hereby used for perforations, through which a fluid passes, of internally situated components. The term openings is used for perforations in components, which perforations allow air to enter the externally situated region from the internally situated region. The arrangement of multiple passages or their ends one after the other in an opening is termed below as a channel, in particular an air channel.

DETAILED DESCRIPTION OF THE INVENTION

Figure 1:
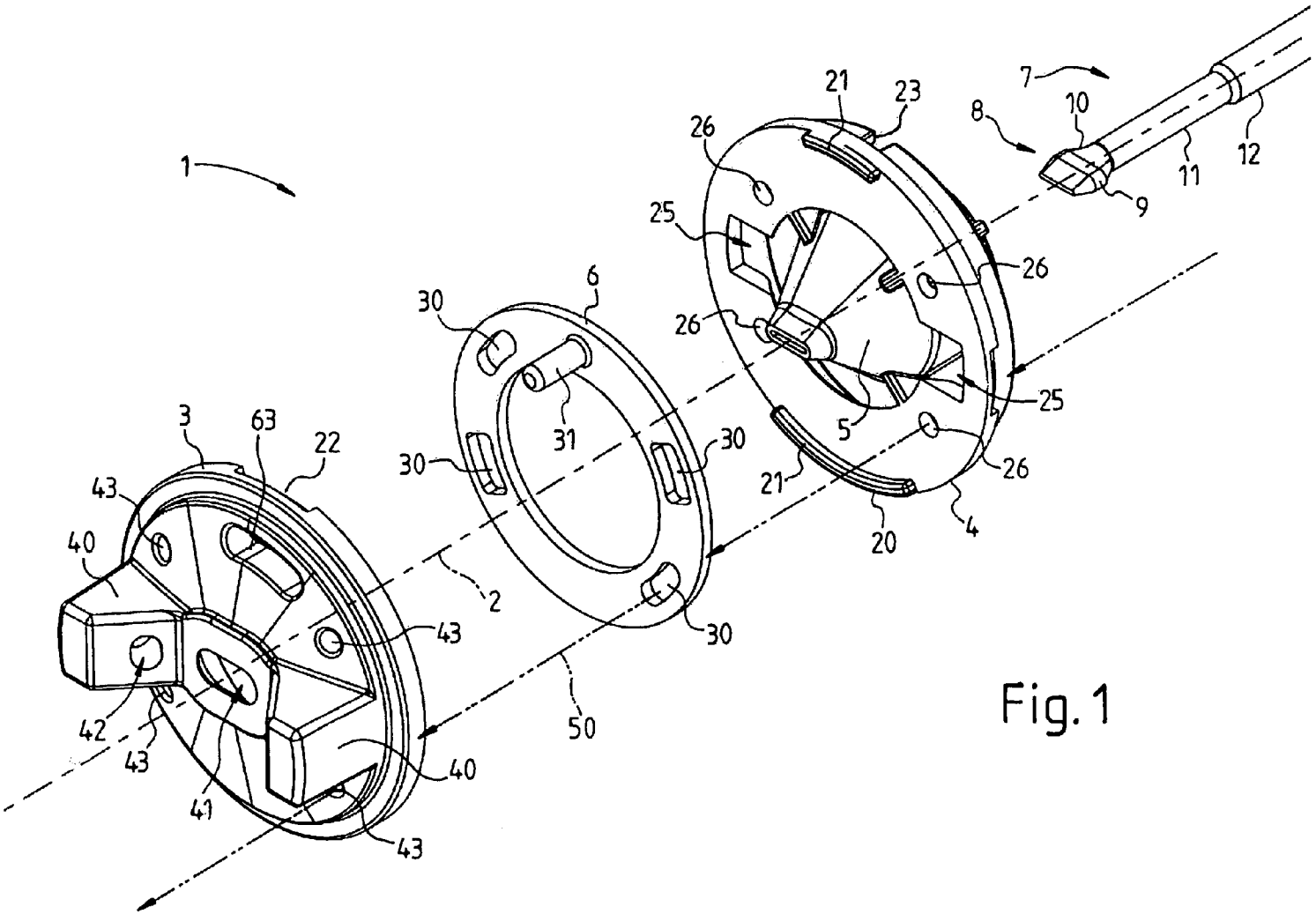
FIG. 1 shows an exploded drawing of the air cap with an air control disk, air gate or needle valve.

In detail, FIG. 1 shows an exploded drawing of a spray head 1 according to the present invention, in which the components are shown spaced apart from one another along an axis of symmetry 2 which essentially corresponds to the spraying direction of the spray head. The spray head 1 hereby comprises an air cap 3, an air gate 4 and a paint nozzle 5, an air control disk 6 being arranged between the air cap 3 and the air gate 4 with the paint nozzle 5.

The paint nozzle 5 is here designed as a needle valve and has a slot-shaped nozzle outlet. The needle head 7, which is introduced into the paint nozzle 5 from the rear, has a wedge shape 8 at its tip which matches the slot-shaped nozzle opening. A valve seat 9, adjoined by a guide 11 and a sealing barrel 12 after a tapered portion 10, adjoins the wedge shape.

The paint nozzle 5 is here suspended centrally in the air gate 4 via connecting ribs 13 (see FIG. 2) and can in this way be used as a component in a paint spray gun according to the present invention. The slot-shaped opening of the paint nozzle 5 hereby projects, viewed in the spraying direction, from the air gate 4 so that the engagement or interpenetration of components arranged one after the other can be obtained.

The air gate 4 has fixing lugs 20 and 21 on its upper side which, when assembled (FIG. 4), engage with corresponding fixing grooves 22 in the air cap 3 and connect both parts together so that they are fixed in rotation. The air gate 4 also has fixing grooves 23 on its rear side which likewise engage with corresponding fixing lugs in the paint spray gun body (not shown). Multiple air passages are designed in the region of the air gate 4 so that they penetrate its upper surface. In addition to a radially circumferential central passage in the air gate, shaping air passages 25 and pressure-relief passages 26 are also provided there. The corresponding shaping air passages 25 and the pressure-relief passages 26 have a radial spacing from the center of the air gate 4 which is selected so that it corresponds to a radial spacing from the center of the air control disk 6 at which control air passages 30 are arranged in the air control disk 6. In this way, the control air passages 30 and the shaping air passages 25, as well as the pressure-relief passages 26, can be made to coincide with one another and form air channels when the spray head is assembled.

The air control disk 6 also comprises an actuating pin 31 and a centrally arranged opening that permits the passage of the paint nozzle and a surrounding flow of sheathing air.

The air cap 3 is arranged on the spray head 1 according to the present invention downstream in the direction of the flow of paint or air. The air cap 3 comprises on its rear side corresponding fixing grooves 22 that make a non-rotational connection to the air gate 4. On its front side, the air cap comprises two air deflection means in the form of air horns 40 which are arranged at the respective narrow ends along a longitudinal axis of a slot-shaped central opening 41 in the air cap. The air horns 40 have shaping air outlets 42 that direct an emerging jet of air toward a jet of paint/air emerging through the slot-shaped central opening 41. Furthermore, the air cap 3 has pressure-relief openings 43 that are arranged at a radial spacing from the slot-shaped central opening 41, and the flow of air emerging from them has no effect on a jet of paint/air emerging through the central opening. According to the present invention, the components can be produced, for example, as either a metal part or as injection-molded plastic parts, depending on what quality requirements and material properties are determined for the individual components. It is also conceivable, for example, for the paint nozzle to be made from metal, the air gate to be made from plastic, and the air cap likewise to be made from plastic, and to use other variations of combinations of materials as part of the manufacture of the components.

The spray head according to the present invention is suitable for applications with air-propelled application processes that atomize the paint using in particular compressed air at an air pressure of no more than 10 bar, or in HVLP processes use a nozzle pressure of less than 0.7 bar (at 10.0 psi) in order to meet HVLP conventions.

A course of a flow of air 50 is also shown by way of example in FIG. 1 which flows from a gun body, not shown, in the current position of the air control disk 6 through a pressure-relief passage 26, a control air passage 30 and a pressure-relief opening 43. In this way, a secondary air channel is formed which removes a flow of pressure-relieving air from the gun housing without affecting the emerging jet of paint/air. In an equivalent fashion, the other passages and openings which are shown and not described in detail are also interconnected to form channels.

Figure 2:
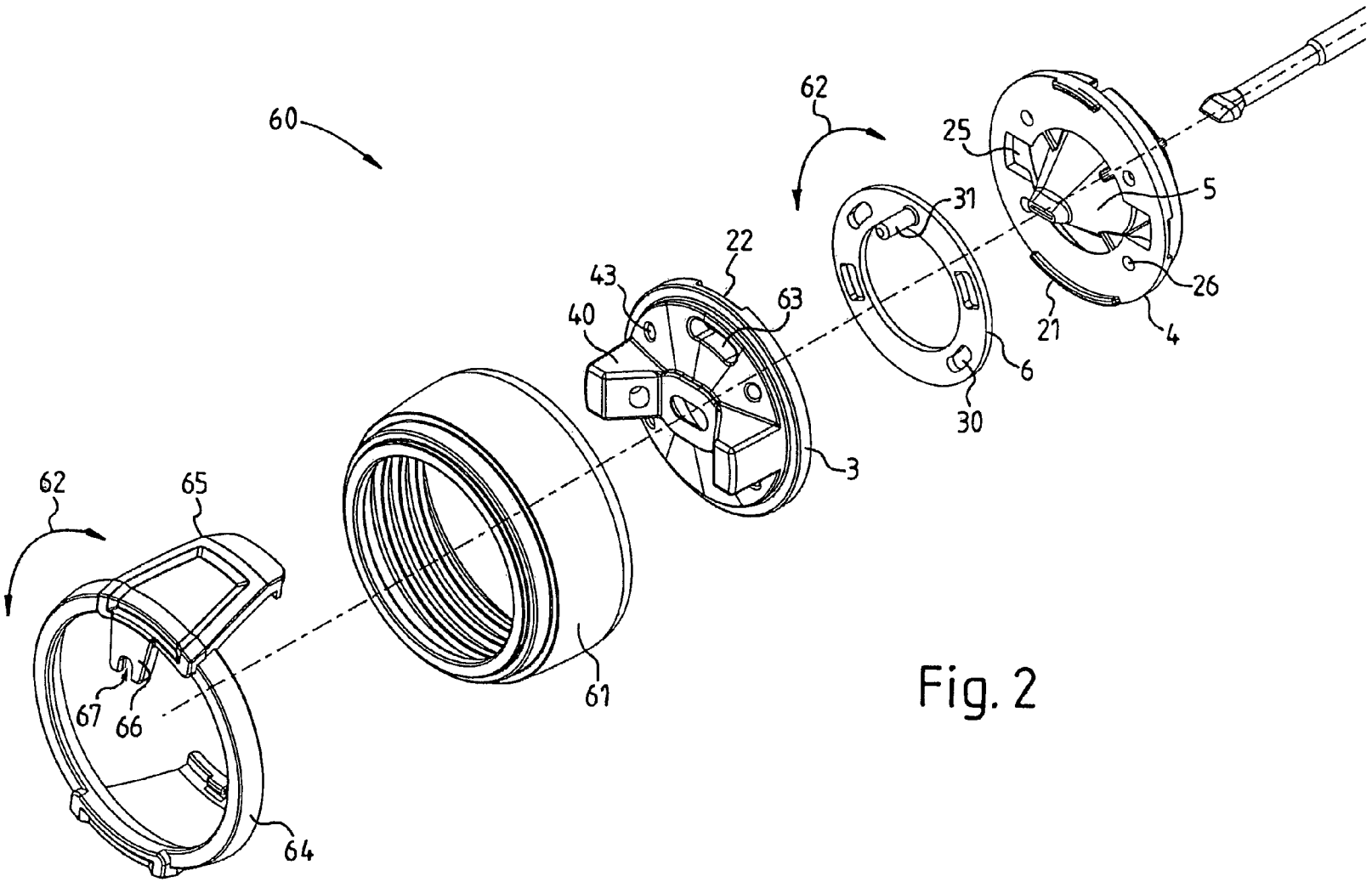
FIG. 2 shows an exploded drawing of a spray head according to the present invention.

FIG. 2 shows another exploded diagram of a spray head 60 according to the present invention, with an air cap 3, an air control disk 6, and an air gate 4 with the paint nozzle 5 arranged therein. In order to fasten the spray head according to the present invention to a paint gun (not shown), a union nut 61 is provided which engages in a thread (not shown here) on the paint gun. The air control disk 6 has control air passages 30 which are arranged in such a way that they can be made to coincide either with the pressure-relief passages 26 of the air gate or with the shaping air passages 25 of the air gate 4. The air cap 3 and air gate 4 are connected to each other so as to be fixed in rotation by the fixing lugs 21 and the fixing grooves 22, the pressure-relief openings 43 and the shaping air passages (not shown here) arranged on the rear side of the air horns 40 being made to coincide with the respective corresponding passages in the air gate 4. The fixing lugs 21 and the fixing grooves 22 have different lengths so as to ensure that the air cap 3 is mounted with the air gate 4 in a functionally appropriate manner. It is thus not possible for the parts to be mounted in a position rotated by 180°. By rotating the air control disk 6 about its center with the rotational movement 62, the control air passages 30 allow either the passage of air through a shaping air channel formed by the shaping air passage 25 and the air guide in the air horn 40, or passage through a pressure-relief air channel which is formed by the pressure-relief passages 26 and the pressure-relief openings 43.

The actuating pin 31 on the air control disk 6 penetrates through an elongated hole 63 when the spray head is assembled.

A rotary actuating means 64, which is clipped over the union nut 61 via clamping wings 65, is arranged in front of the union nut 61. The rotary actuating means 64 has a catch 66 which engages with a protrusion at the front of the actuating pin 31 in the mounted state, and carries the actuating pin 31 along. In this way, the rotational movement 62 can be transmitted via the rotary actuating means 64 to the actuating pin 31, and it is thus possible to switch easily between the guidance of air through a shaping air channel and the guidance of air through the pressure-relief channels.

Figure 3:
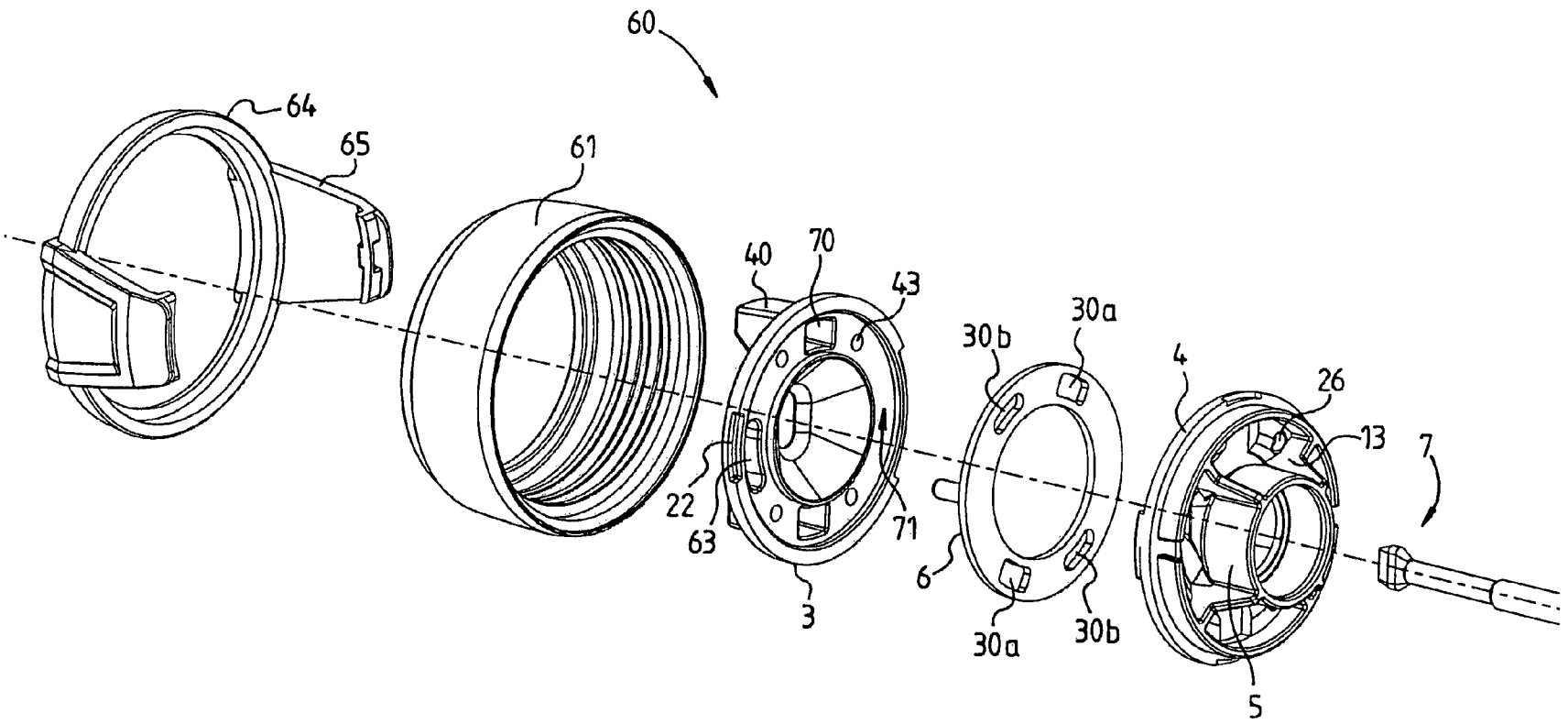
FIG. 3 shows a rear view of the illustration in FIG. 2.

FIG. 3 shows a spray head according to the present invention as in FIG. 2 in a rear view. It is hereby clear that the control air passages 30 can have different cross-sectional areas 30*a* and 30*b* in the air control disk 6, depending on whether they are suitable for forming a shaping air channel or serve only to form a pressure-relief air channel.

Shaping air inlets 70 are arranged on the rear side of the air cap 3, through which a flow of shaping air enters an air horn 40 and can act on a jet of paint/air via the shaping air outlet opening 42 (see FIG. 2).

The air cap 3 has on its rear side a depression 71 which is dimensioned for receiving the air control disk 6, so that the air control disk 6 can be arranged between the air cap 3 and the air gate 4 when the spray head is assembled, but is not held secure by the pressure applied by the union nut 61 and instead remains capable of rotating inside the depression 71.

Figure 4:
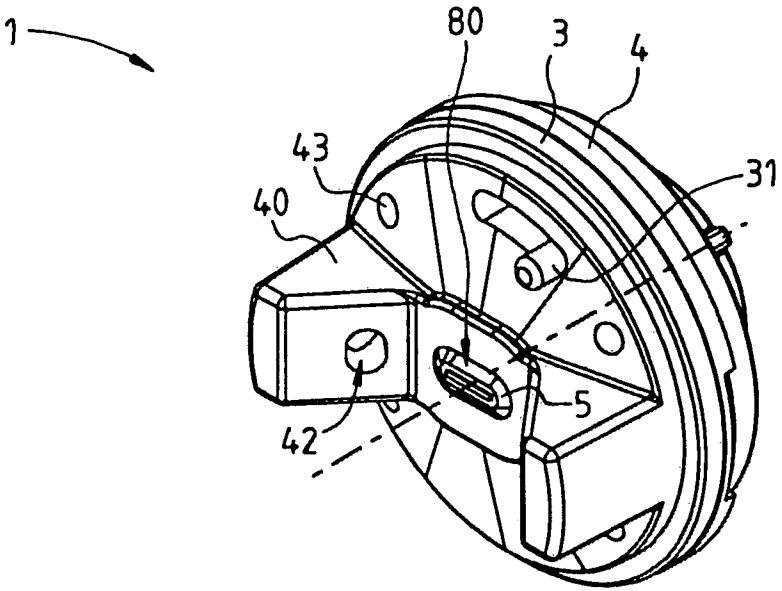
FIG. 4 shows an assembled illustration in FIG. 1.

FIG. 4 shows an assembled arrangement of the components in FIG. 1, in which the air control disk 6 is now accommodated in the internal region between the air gate 4 and the air cap 3. The slot-shaped tip of the paint nozzle 5 penetrates through the region of the slot-shaped central opening 41 in the air cap 3 or forms a plane with the latter. An annular gap 80, through which a flow of sheathing air that conveys and atomizes the paint emerging from the paint nozzle 5 is guided, is formed between the edge of the slot-shaped central opening 41 and the edge of the slot-shaped paint nozzle 5.

Depending on the application and the material used, the dimensions of the slot-shaped paint nozzle 5, the slot-shaped central opening 41 and thus the annular gap 80 are adapted so as to optimize the atomization of the material to be applied.

Figure 5:
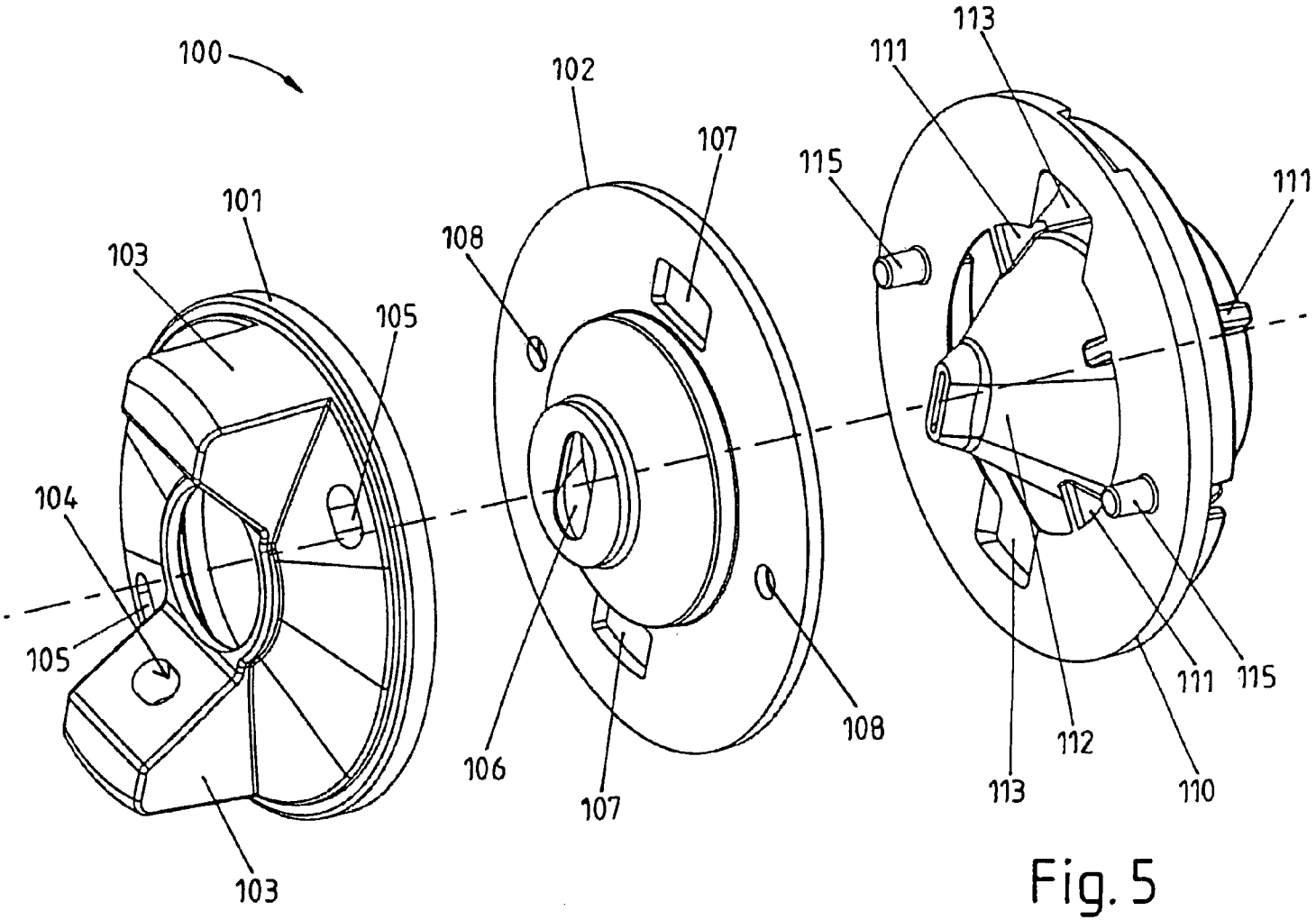
FIG. 5 shows an exploded drawing of a further arrangement according to the present invention of a (two-piece) air cap, an air gate, and a paint nozzle.

FIG. 5 shows another design of a spray head 100 according to the present invention, in which the air cap is designed as a two-part element comprising a horn cap 101 and an annular gap cap 102. The horn cap 101 hereby has air horns 103 on which shaping air outlets 104 are arranged, where the flow of air emerging from the latter can act on a central jet of paint/air. The horn cap 101 also has pressure-relief openings 105 which are arranged at a radial spacing from the center of the horn cap 101.

The annular gap cap 102 has a slot-shaped central opening 106 in its central region, wherein this slot-shaped central opening 106 is surrounded laterally by corresponding projections and deformations to improve the fit when the horn cap 101 is assembled with the annular gap cap 102. Furthermore, the annular gap cap has air passages 107 which are arranged, symmetrically opposite each other, at a radial spacing on the narrow sides of the slot-shaped central opening 106. The upper surface of the annular gap cap 102 is moreover perforated by holes 108 which are not used as air passages.

An air gate 110, which has a paint nozzle 112 with a slot-shaped nozzle opening arranged at its center on connecting ribs 111, is arranged upstream from the horn cap and the annular gap cap, in the direction of the flow of air. The air gate 110 has air passages 113 which are radially spaced apart from a center by a distance that is selected so that it corresponds to the radial spacing of the air passages 107 in the annular gap cap 102, and the pressure-relief openings 105 in the horn cap 101, and the shaping air outlet channels 104 in the air horns 103 of the horn cap 101.

Fixing grooves 114 are provided on the rear side of the air gate 110 and allow the arrangement to be fixed inside a gun body.

Furthermore, studs 115, onto which the annular gap cap is pushed and which penetrate the holes 108, are arranged on the upper surface of the air gate 110. In this way, the annular gap cap 102 is connected to the air gate 110 so as to be fixed in rotation, as a result of which, in a similar fashion to the description of FIG. 4, an annular gap for the passage of a flow of sheathing gas is formed between the edge of the slot-shaped central opening 106 in the annular gap cap and the edge of the paint nozzle 112.

Figure 6:
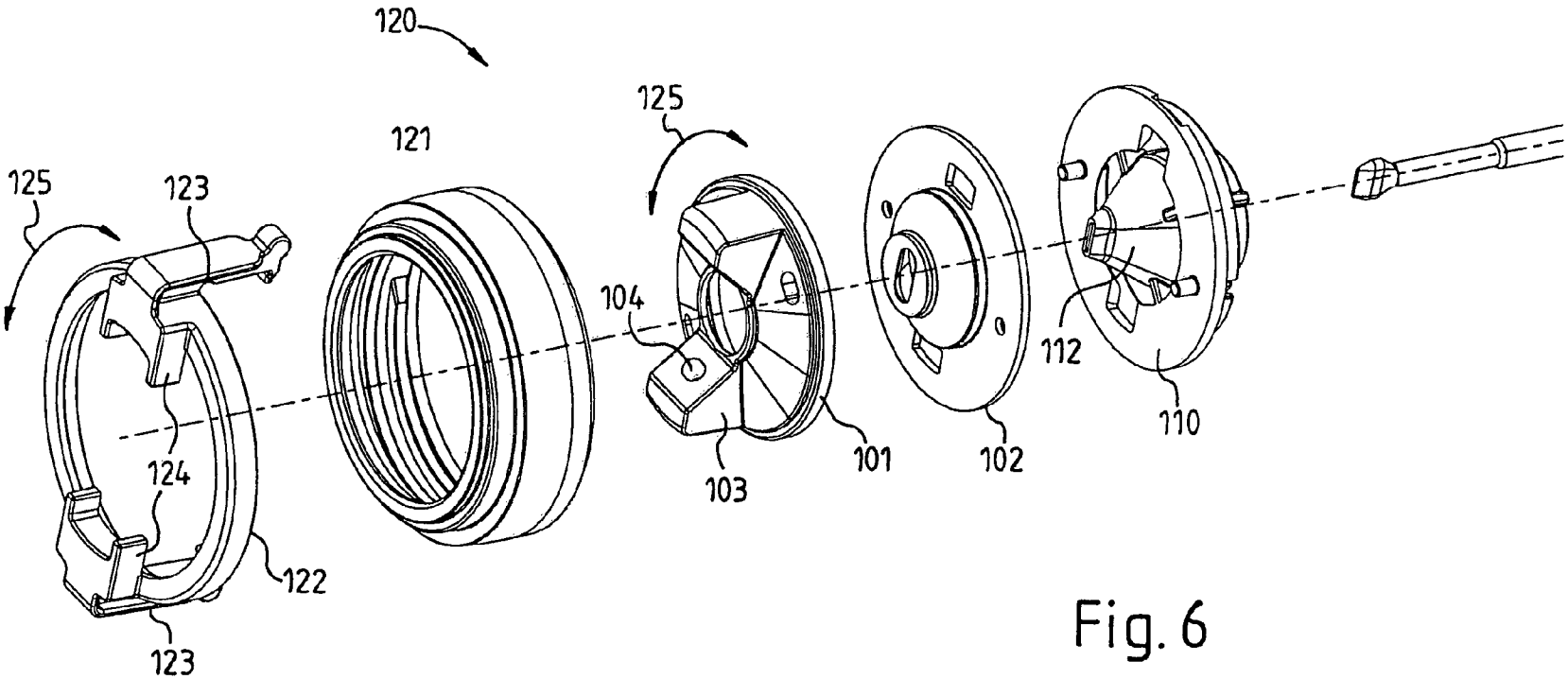
FIG. 6 shows an exploded drawing of a further spray head according to the present invention.

FIG. 6 shows another exploded view of an arrangement with a spray head according to the present invention corresponding to FIG. 5, this spray head 120 also comprising a union nut 121 and a rotary actuating means 122.

The rotary actuating means 122 clips onto the union nut 121 via clamping wings 123 and has catches 124 which carry the air horns 103 of the horn cap 101 along when a rotational movement 125 is effected. When assembled, the air cap 103 is arranged so that it bears rotatably on the annular gap cap 102 so that the air passages on the rear side of the horn cap 101, which open into the pressure-relief openings 105 or the shaping air outlets 104, can be rotated into a position above the air passages 107. An air channel can thereby be formed alternatively through the air passages 113 in the air gate 110, the air passages 107 in the annular gap cap 102, and alternatively through the pressure-relief openings 105 in the horn cap 101 or the shaping air outlets 104 in the horn cap 101.

Figure 7:
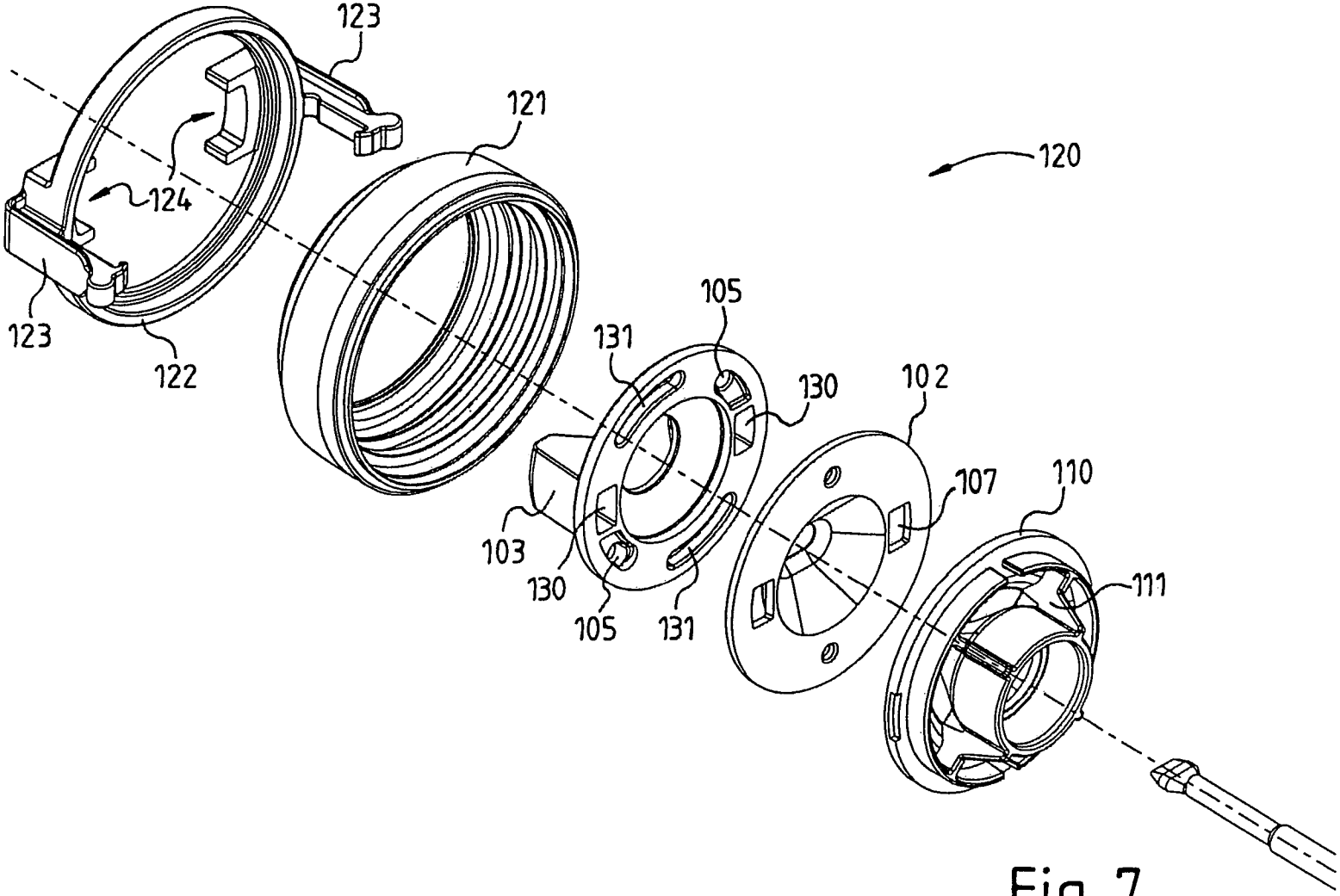
FIG. 7 shows a rear view of the arrangement according to the present invention in FIG. 6.

FIG. 7 shows a rear view of the illustration in FIG. 6.

Shaping air inlets 130, which open into the shaping air outlets 104 of the air horns 103, are provided on the rear side of the horn cap 101. The pressure-relief openings 105 are arranged in a radially circumferential fashion, offset to the shaping air inlets 130, it being possible for the pressure-relief openings 105 to be made to coincide with the air passages 107 in the annular gap cap 102 that correspond to the shaping air inlets 130 by rotating the horn cap 101, and hence form pressure-relief air channels where the flow of air does not act on a centrally emerging jet of paint/air.

Two elongated holes 131 are moreover provided on the rear side of the horn cap 101, into which elongated holes 131 the studs 115 (see FIG. 5) of the air gate 110, which penetrate through the holes 108 in the annular gap cap 2, engage, and in conjunction with the elongated hole 131 form a limit stop for rotation which ensures, on the one hand, the correct coinciding positioning of the pressure-relief openings and, on the other hand, the correct coinciding positioning of the shaping air inlets 130 via the air passages 107.

Figure 8:
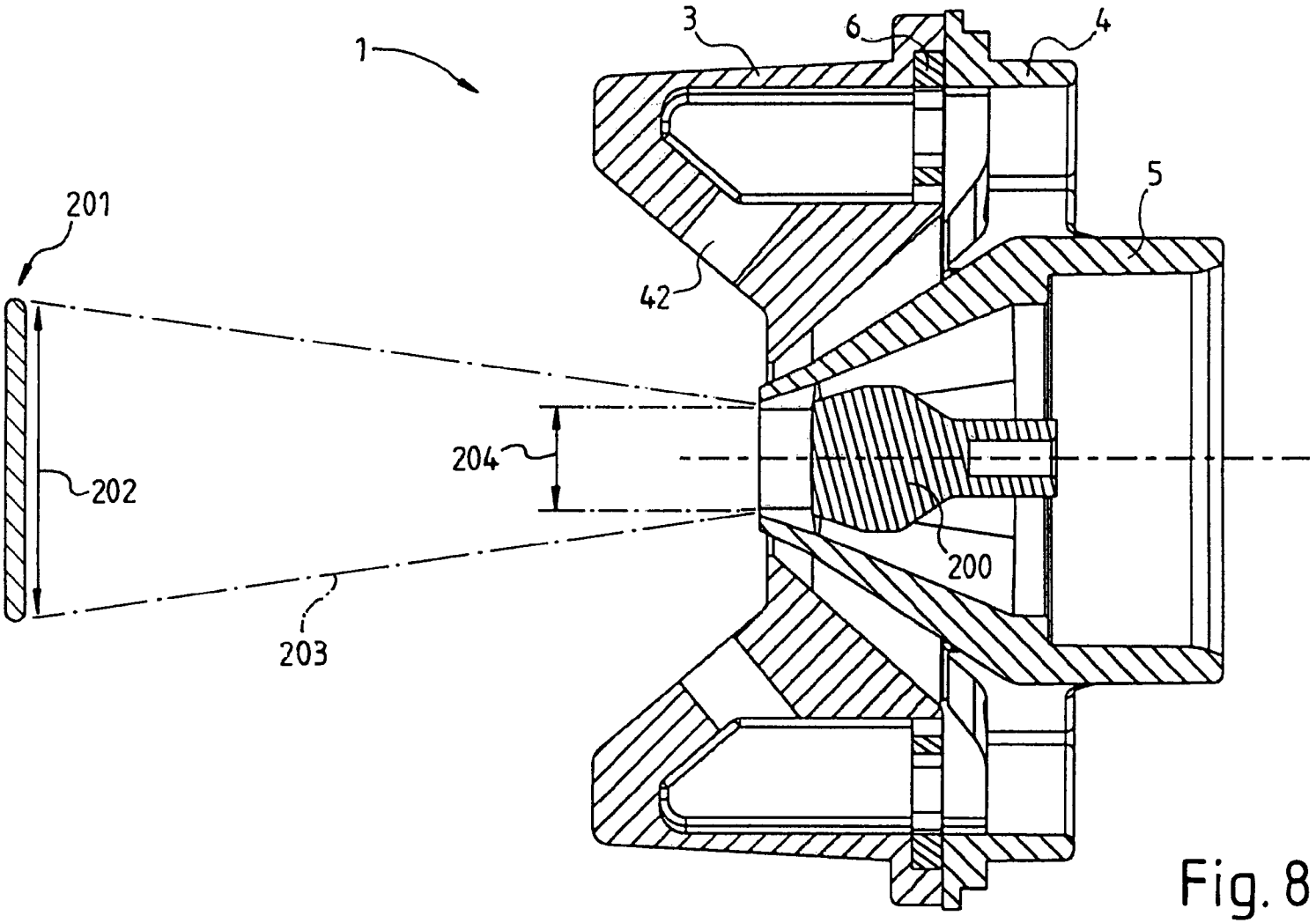
FIG. 8 shows a view in cross-section through an assembled arrangement according to FIG. 4 along the longitudinal axis of the slot.

A spray head 1 according to the present invention is shown in FIG. 8 in a cross-sectional view along the longitudinal axis of the slot-shaped paint nozzle 5 and the slot-shaped central opening 41 of the air cap 3. The paint nozzle 5 hereby comprises a needle head 200 which is shown here in a slightly retracted position so that a situation in which paint can emerge is obtained.

A spray pattern 201 which strikes a working surface has a transverse extent 202, wherein a normal processing distance should be chosen for the working surface that corresponds, for example, to the distance of a varnisher from a wall or a workpiece which is to be varnished. The projected course of the paint jet is indicated by a schematically illustrated spray limit 203. The transverse extent 202 is substantially parallel to the longitudinal extent of the slot 204, which corresponds to the slot width of the paint nozzle or the slot width of the slot-shaped central opening 41. Depending on the position of the air control disk 6, shaping air openings 42 provide a flow of shaping air which acts laterally on the emerging jet of paint/air and deforms the spray limit 203 so that it approaches a central spraying axis.

Figure 9:
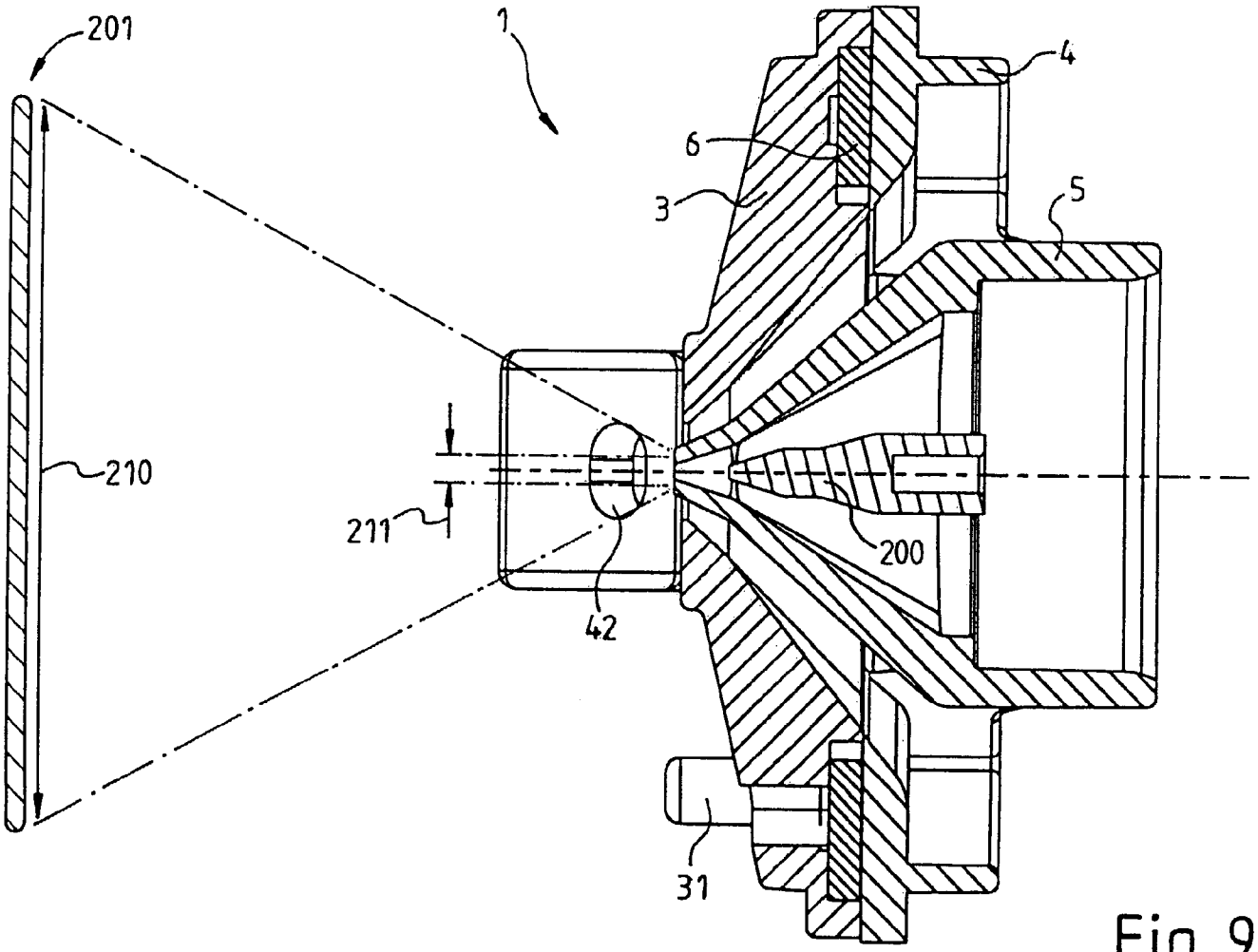
FIG. 9 shows a view in cross-section along the transverse axis of the slot of an assembled arrangement according to FIG. 4.

FIG. 9 shows the situation in FIG. 8 again in a central cross-sectional view but rotated by 90°.

In this position, the spray pattern 201 has a much greater longitudinal extent 210, the distance from the working plane being chosen so that it corresponds to the distance in FIG. 8. The longitudinal extent 210 of the spray pattern 201 extends substantially parallel to the transverse extent of the slot 211 so that a longitudinal or transverse axis of the jet of paint/air in the form of a spray pattern 201 emerges rotated by 90° with respect to a longitudinal or transverse axis of a slot-shaped central opening 41 and/or a slot-shaped paint nozzle, whereby a vertically extending flat jet of paint results from a horizontally extending slot-shaped central opening. FIG. 9 also shows the passage of the actuating pin 31 for the air control disk 6 through the surface of the air cap 3.

Figure 10:
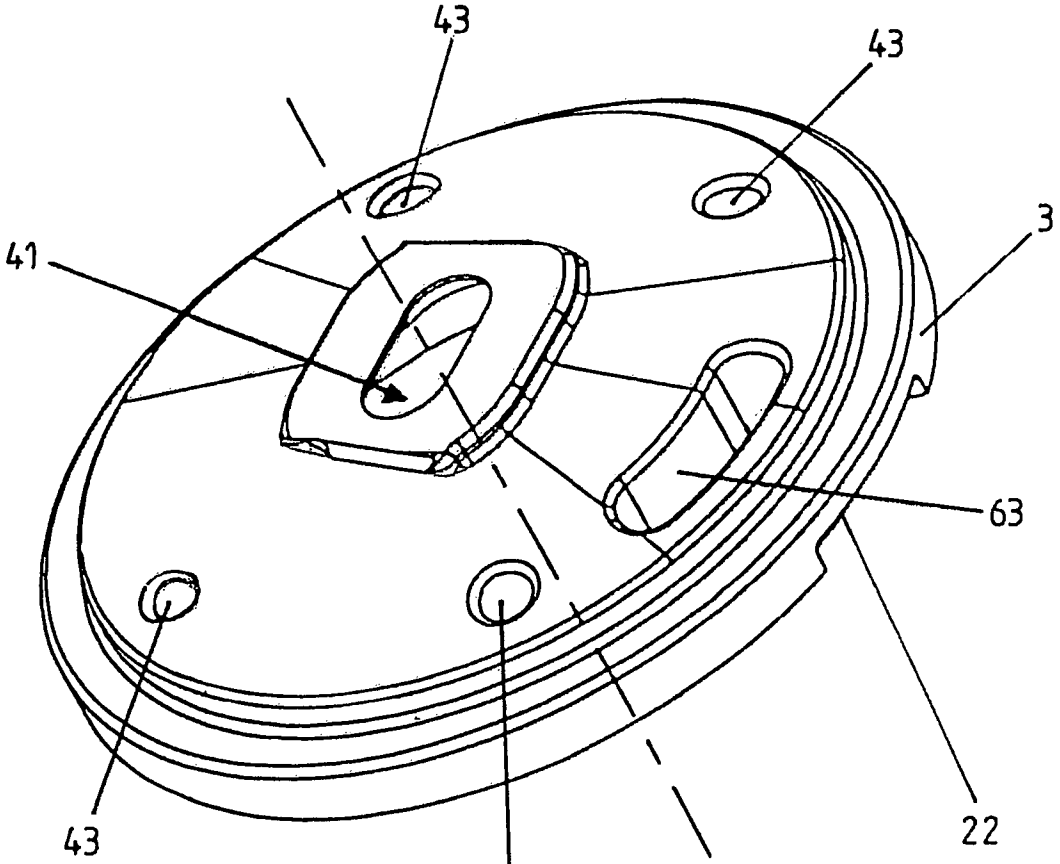
FIG. 10 is an exploded drawing of an air cap with no air deflection.

FIG. 10 shows the air cap 3 according to FIG. 1 which has pressure-relief openings 43 and a centrally arranged slot-shaped central opening 41 on its surface facing the spraying direction. In contrast with FIG. 1, there are no air deflection means in the form of air horns 40 arranged on the air cap.

The present invention is not, however, limited to the exemplary embodiments shown.

Rather, it encompasses all arrangements that may be of use in the approach according to the present invention. Other types of application are also conceivable in which the spray head arrangement according to the present invention can be used for air-propelled application processes.

LIST OF REFERENCE NUMERALS

1 spray head
2 axis of symmetry
3 air cap
4 air gate
5 paint nozzle

6 air control disk
7 needle head
8 wedge shape
9 valve seat
10 tapered portion
11 guide
12 sealing barrel
13 connecting rib
20 fixing lug
21 fixing lug
22 fixing groove
23 fixing groove
25 shaping air passage
26 pressure-relief air passages
30 control air passages
30*a* cross-sectional surface
30*b* cross-sectional surface
31 actuating pin
40 air horn
41 slot-shaped central opening
42 shaping air outlet
43 pressure-relief opening
50 course of air flow
60 spray head
61 union nut
62 rotational movement
63 elongated hole
64 rotary actuating means
65 clamping wing
66 catch
67 protrusion
70 shaping air inlet channels
71 depression
80 annular gap
100 spray head
101 horn cap
102 annular gap cap
103 air horn
104 shaping air outlet
105 pressure-relief openings
106 central opening
107 air passage
108 hole
110 air gate
111 connecting rib
112 paint nozzle
113 air passage
114 fixing groove
115 studs
120 spray head
121 union nut
122 rotary actuating means
123 clamping wing
124 catch
125 rotational movement
130 shaping air inlets
131 elongated hole=rotation limit
200 needle head
201 spray pattern
202 transverse extent
203 spray limit
204 longitudinal extent of the slot
210 longitudinal extent
211 transverse extent of the slot

We claim:

1. A spray head for producing a paint fan jet from at least one of a paint spray gun and a paint spray lance, the spray head comprising:

an air gate;

a paint nozzle having a needle valve;

an air cap arranged downstream of the air gate in a direction of air flow;

a passage opening for the paint nozzle to pass, arranged centrally in the air gate;

a passage opening arranged centrally in the air cap for at least one of the paint jet and the paint nozzle and a jacket air flow surrounding the at least one of the paint jet and the paint nozzle to pass;

at least one air passage opening radially spaced apart from the centrally arranged passage opening in the air gate;

at least one air deflecting means arranged on an air passage opening associated therewith in the air cap, and deflecting a passing air jet in a direction of at least one of the paint jet and the paint jet and the jacket air flow surrounding the paint jet;

wherein the air passage opening in the air cap and the at least one air passage opening in the air gate have a comparable radial distance from the center of the air cap and the air gate, respectively, wherein the central passage opening in the air cap is made as a slotted air cap opening with a longitudinal length of the air cap opening and a transverse length of the air cap opening, made to be shorter than said longitudinal length, wherein the paint nozzle is made as a slotted paint nozzle opening with a longitudinal length of the paint nozzle opening and a transverse length of the paint nozzle opening, made to be shorter than said longitudinal length, wherein said longitudinal length and said transverse length of the paint nozzle opening extend parallel to said longitudinal length and said transverse length, respectively, of the central air cap opening in the air cap, and wherein the air deflecting means is arranged on a small face of the central air cap opening along said longitudinal length, and a paint jet leaving the spray head is broadened along said transverse length of the air cap opening.

2. The spray head according to claim 1, wherein two air deflecting means are provided symmetrically to the center of the air cap, and at least one relief opening radially spaced apart from the center of the air cap is provided for a relief airstream in the air cap.

3. The spray head according to claim 2, wherein in the air gate, at least one relief air passage is provided a radial position of which corresponds to the radial position of the at least one relief opening in the air cap.

4. The spray head according to claim 3, wherein means are provided which alternatively provide with air either the at least one relief opening or the air deflecting means, and wherein the means are formed preferably by a plate cam having a centrally arranged jacket air passage and at least one control air passage located radially outside of the jacket air passage.

5. The spray head according to claim 2, wherein means are provided which alternatively provide with air either the at least one relief opening or the air deflecting means, and wherein the means are formed preferably by a plate cam having a centrally arranged jacket air passage and at least one control air passage located radially outside of the jacket air passage.

6. The spray head according to claim 5, wherein the plate cam is made to be rotatable in relation to at least one of the air gate and the air cap.

7. The spray head according to claim 2, wherein the at least one relief opening is two relief openings.

8. The spray head according to claim 2, wherein the at least one relief opening is four relief openings.

9. The spray head according to claim 1, wherein the at least one opening in total has approximately the same cross-sectional area as a total of the cross-sectional area of the air passage openings of the air deflecting means.

10. The spray head according to claim 9, wherein in the air gate, at least one relief air passage is provided a radial position of which corresponds to the radial position of the at least one relief opening in the air cap.

11. The spray head according to claim 9, wherein means are provided which alternatively provide with air either the at least one relief opening or the air deflecting means, and wherein the means are formed preferably by a plate cam having a centrally arranged jacket air passage and at least one control air passage located radially outside of the jacket air passage.

12. The spray head according to claim 1, wherein the paint nozzle is connected to the air gate via connecting webs configured integrally by injection molding.

13. The spray head according to claim 1, wherein a produced paint fan jet impinges on a working plane spaced apart from the spray head by a working distance and vertical to the spraying direction, with the longitudinal length of the fan jet and the transverse length of the fan jet, made to be shorter than the longitudinal length of the fan jet, being twisted by 90° about the spraying direction with respect to the longitudinal length of the slotted air cap opening and the transverse length of the slotted air cap opening.

14. The spray head according to claim 1, wherein the at least one air deflecting means is an air horn.

15. The spray head according to claim 1, wherein the spray head is releasably fastened to one end of the one of the paint spray gun and the paint spray lance.

16. The spray head according to claim 1, wherein the spray head is releasably fastened by a union nut which engages in threading on the one of the paint spray gun and the paint spray lance.

17. A spray head for producing a paint fan jet on at least one of a paint spray gun and a paint spray lance, the spray head comprising:

an air guide;

a paint nozzle having a needle valve;

an air cap arranged downstream of the air guide in the direction of air flow;

a passage opening arranged centrally in the air guide for the paint nozzle to pass; and a passage opening arranged centrally in the air cap for at least one of the paint jet and the paint nozzle and a jacket air flow surrounding the at least one of the paint jet and the paint nozzle to pass;

wherein the center passage opening in the air cap is made as a slotted opening with a longitudinal length of the air cap opening and a transverse length of the air cap opening, made to be shorter with respect thereto, wherein the paint nozzle is made as a slotted paint nozzle opening with a longitudinal length of the paint nozzle opening and a transverse length of the paint nozzle opening, made to be shorter with respect thereto, wherein the longitudinal length and the transverse length of the paint nozzle extend parallel to the longitudinal length and the transverse length, respectively, of the central air cap opening in the air cap, and wherein the air deflecting means is arranged on a small face of the central air cap opening along said longitudinal length, and a paint jet leaving the spray head is broadened along said transverse length of the air cap opening.

18. The spray head according to claim 17, wherein a produced paint fan jet impinges on a working plane spaced apart from the spray head by a working distance and vertical to the spraying direction, wherein the longitudinal length of the fan jet and the transverse length of the fan jet, made to be shorter than the longitudinal length of the fan jet, are pivoted with respect to the longitudinal length of the slotted air cap opening and the transverse length of the slotted air cap opening by 90° about the spraying direction.

19. The spray head according to claim 17, wherein the spray head is releasably fastened to one end of the one of the paint spray gun and the paint spray lance.

20. The spray head according to claim 17, wherein the spray head is releasably fastened by a union nut which engages in threading on the one of the paint spray gun and the paint spray lance.

* * * * *